US007886839B2

(12) United States Patent
Frauhammer et al.

(10) Patent No.: US 7,886,839 B2
(45) Date of Patent: Feb. 15, 2011

(54) HAND-HELD POWER TOOL WITH IMPROVED VIBRATION-DAMPED HANDLE

(75) Inventors: Karl Frauhammer, Leinfelden-Echterdingen (DE); Gerhard Meixner, Filderstadt (DE); Heiko Roehm, Stuttgart (DE); Willy Braun, Neustetten (DE); Axel Kuhnle, Freiberg (DE); Andreas Strasser, Rudersberg (DE); Ralph Dammertz, Stuttgart (DE); Joachim Schadow, Dettenhausen (DE); Christian Koepf, Denkendorf (DE); Juergen Lennartz, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/539,816

(22) Filed: Aug. 12, 2009

(65) Prior Publication Data

US 2009/0294144 A1 Dec. 3, 2009

Related U.S. Application Data

(63) Continuation of application No. 11/326,046, filed on Jan. 5, 2006, now abandoned.

(30) Foreign Application Priority Data

Feb. 18, 2005 (DE) ..... 10 2005 007 547

(51) Int. Cl.
*B25D 17/24* (2006.01)

(52) U.S. Cl. ..... 173/162.2; 173/162.1; 173/217

(58) Field of Classification Search ..... 173/162.1, 173/162.2, 217
See application file for complete search history.

(56) References Cited

U.S. PATENT DOCUMENTS

| | | | | | |
|---|---|---|---|---|---|
| 3,728,793 | A | * | 4/1973 | Makinson et al. | 30/383 |
| 4,287,785 | A | * | 9/1981 | Hunt | 74/488 |
| 4,290,492 | A | * | 9/1981 | Sides et al. | 173/118 |
| 4,667,749 | A | * | 5/1987 | Keller | 173/162.2 |
| 4,749,049 | A | * | 6/1988 | Greppmair | 173/162.2 |
| 5,170,532 | A | * | 12/1992 | Holmin et al. | 16/431 |
| 5,345,684 | A | * | 9/1994 | Shoup et al. | 30/276 |
| 5,573,358 | A | * | 11/1996 | Gobbers et al. | 408/35 |
| 5,749,421 | A | * | 5/1998 | Johansson et al. | 173/162.2 |

(Continued)

FOREIGN PATENT DOCUMENTS

DE 1 752 856 4/1971

(Continued)

*Primary Examiner*—Brian D Nash
(74) *Attorney, Agent, or Firm*—Michael J. Striker

(57) ABSTRACT

The hand-held power tool has a vibration-damped main handle. The hand-held power tool has a device for fastening the main handle to a main element configured so that when the main element moves out of a stationary position toward the main handle the main element swivels around at least one swivel axis so that it is guided along a trajectory that extends with a slant of at least 10° relative to a flat surface, which extends through a longitudinal tool axis and which has a surface normal oriented in a normal direction perpendicular to the longitudinal tool axis. As a result vibrations with a movement component perpendicular to the longitudinal tool axis are damped as well as vibrations that induce motion of the main element in the direction of the longitudinal tool axis toward the main handle.

20 Claims, 6 Drawing Sheets

U.S. PATENT DOCUMENTS

| | | | | |
|---|---|---|---|---|
| 5,893,295 | A * | 4/1999 | Bronnert | 74/488 |
| D411,426 | S * | 6/1999 | Morita | D8/69 |
| 6,155,916 | A * | 12/2000 | Rudolf et al. | 451/344 |
| 6,241,594 | B1 * | 6/2001 | Lepold | 451/359 |
| D447,032 | S * | 8/2001 | Schoen et al. | D8/67 |
| 6,394,885 | B2 * | 5/2002 | Georgiou | 451/359 |
| D463,238 | S * | 9/2002 | Schoen et al. | D8/70 |
| D467,484 | S * | 12/2002 | Schoen et al. | D8/70 |
| D492,177 | S * | 6/2004 | Wright et al. | D8/70 |
| 6,834,565 | B2 * | 12/2004 | Cohen et al. | 74/551.9 |
| 6,978,694 | B2 * | 12/2005 | Peppard | 74/489 |
| 7,100,706 | B2 | 9/2006 | Meixner et al. | |
| 2001/0011846 | A1 * | 8/2001 | Krondorfer et al. | 310/17 |
| 2003/0037937 | A1 * | 2/2003 | Frauhammer et al. | 173/48 |
| 2004/0040729 | A1 * | 3/2004 | Meixner | 173/162.2 |
| 2004/0107789 | A1 * | 6/2004 | Peppard | 74/484 R |
| 2004/0200307 | A1 * | 10/2004 | Mitchell | 74/502.2 |
| 2005/0285369 | A1 * | 12/2005 | Jiun Gu | 280/288.4 |
| 2006/0053937 | A1 * | 3/2006 | Chen | 74/501.6 |

FOREIGN PATENT DOCUMENTS

| | | |
|---|---|---|
| WO | 02/083369 | 10/2002 |

* cited by examiner

HAND-HELD POWER TOOL WITH IMPROVED VIBRATION-DAMPED HANDLE

CROSS-REFERENCE

The present application is a continuation application of U.S. application Ser. No. 11/326,046 filed on Jan 5, 2006, now abandoned. The invention described and claimed hereinbelow is also described in DE 10 2005007547.9, filed on Feb. 18, 2005. This German Patent Application, whose subject matter is incorporated here by reference, provides the basis for a claim of priority of invention under 35 U.S.C. 119(a)-(d).

BACKGROUND OF THE INVENTION

The present invention is directed to a hand-held power tool.

Rotary hammers are made known in publication DE 38 39 207 A1, in the case of which a rear main handle is supported such that it is movable relative to the rest of the rotary hammer. As a result of the movable support, combined with a spring element, vibration damping of the main handle is achieved, since oscillatory motions travelling from the tool toward the main handle are largely absorbed.

SUMMARY OF THE INVENTION

Accordingly, it is an object of the present invention to provide a hand-held power tool which is a further improvement of the existing tools.

The present invention is directed to a hand-held power tool, in particular a rotary hammer and/or chisel hammer, composed of a main element and a main handle fastened to said main element, wherein said main handle is supported such that said main handle is movable relative to said main element, wherein said main element includes a tool fitting that defines a longitudinal tool axis and a center of gravity, wherein a normal direction which starts from said longitudinal tool axis and is oriented perpendicular to said longitudinal tool axis points towards said center of gravity.

In accordance with the present invention means are provided for fastening said main handle to said main element configured so that when said main element is moved out of a stationary position toward said main handle at least a portion of said main element is guided along a trajectory having a movement component in the normal direction, wherein said means for fastening said main handle to said main element are configured so that the trajectory of the portion extends with a slant of at least 10° relative to a flat surface imagined to extend through the tool axis, with the normal direction as the surface normal, in the direction of the half-space in which the center of gravity is located. As a result, not only vibrations that induce motions of the main element from the tool toward the main handle can be damped, but also vibrations that induce a movement component of the main element in the normal direction or around the center of gravity. As a result, the overall vibration damping of the main handle is improved considerably.

During operation, a hand-held power tool typically vibrates to a great extent in the direction in which it is pressed against a tool or a work piece. The extent of vibration damping of the main handle is therefore typically determined by the damping of the main handle in the working direction.

An action of force on the main element in the direction of the tool axis causes the main element to move with a rotation component, especially with hand-held power tools with which the center of gravity of the main element is far away from the tool axis.

As a result, the part of the main element facing away from the tool makes a motion that has a movement component in the direction of the tool axis and a movement component in the normal direction. Given a movability of the main element relative to the handle such that this part of the main element can oscillate in a trajectory with a movement component in the normal direction, the handle can also be at least largely decoupled from this oscillation, which is oriented perpendicularly to the tool axis.

With a hand-held power tool for shank tools, for which the present invention described here is particularly advantageous, the tool axis—which is determined by the tool fitting—extends in the longitudinal axis and/or shank axis of the shank tool. The main element can include everything fastened to the hand-held power tool except for the main handle. In addition to the main handle, the hand-held power tool can also include an additional handle.

The "stationary position" can be understood to be a position of the main handle relative to the main element in which no external forces are applied to the main handle, e.g., by an operator. In the stationary position, the main handle is typically pressed against a stop by a spring element. The portion of the main element guided in the normal direction along a trajectory with a movement component is a significant portion of the main element. A portion such as this comprises 10 percent by weight, and particularly at least 35 percent by weight of the main element, a portion of more than 50 percent by weight of the main element resulting in a particularly good vibration damping of the main handle.

The ratio of the movement component of the portion in the normal direction and the movement component of the portion in the direction of the tool axis should also be significant. The movement component of the portion in the normal direction advantageously comprises at least 18% of the total movement of the portion. In other words: The trajectory of the portion extends with a slant of at least 10° relative to a flat surface imagined to extend through the tool axis, with the normal direction as the surface normal, in the direction of the half-space in which the center of gravity is located.

Good damping can be obtained in a particularly simple, economical manner when the main handle is capable of swiveling around a single pivot axis relative to the main element, the pivot axis being located in front of a—possibly another—main element portion of at least 10 percent by weight of the main element. The directions "front" and "back" are defined relative to the tool axis, the tool fitting being located at the front of the hand-held power tool.

A particularly stable movement guidance of the handle can be obtained when the main handle is capable of being swiveled relative to the main element around at least two pivot axes. The main handle is advantageously capable of being swiveled via two rotating elements capable of being swiveled around the pivot axes and moved relative to the main handle, so that the main handle is capable of being swiveled relative to the main element, in particular around four pivot axes. Via the selection of the orientation and length of the two rotating elements relative to each other, a high degree of flexibility can be obtained in terms of adjusting the trajectory of the main element relative to the main handle.

The rotating elements can be of equal length and parallel with each other, by way of which a translatory motion of the main element on a circular trajectory around the main handle is obtainable. By selecting rotating elements having different lengths, a rotatory motion of the main element relative to the stationary main handle can be obtained in addition to the translatory motion. A rotatory motion can also be achieved when the rotating elements form an angle >0° with each other when they are in the resting position, i.e., when they are not parallel.

The selection of the trajectory of the main element relative to the stationary main handle is advantageously adapted to the main direction of oscillation that occurs during operation of the hand-held power tool and in which the part of the main element to which the main handle is fastened moves during operation. The main direction of oscillation is the direction of the greatest oscillation of the part. An adaptation occurs when the main element can carry out at least ¾ of the oscillation relative to the stationary main handle.

A simple design for fastening the main handle while ensuring a high level of flexibility in terms of selection of the trajectory can be achieved when the rotating elements are supported in individual supports in a pivoting manner at their ends facing away from the main handle, and a straight line extending through the support forms an angle >45° with the tool axis. In particular, this line is located substantially perpendicular to the tool axis.

A stable guidance of the hand-held power tool during machining of a work piece can be obtained when the movement of the main handle relative to the main element is kept in a single dimension. The possible motion that the main element can carry out relative to the main handle is therefore a purely one-dimensional motion, i.e., a purely linear motion. This linear motion can be curved.

A high damping effect can be achieved when—with the main handle remaining stationary—the main element makes a rotational movement of its own around a joint-free axis of rotation when it moves from a stationary position and approaches the main handle. This axis of rotation does not pass through a pivotal point. Instead, it passes a site that is favorable for vibration damping, e.g., through a motor housing or entirely outside of the hand-held power tool.

It is also possible that the axis of rotation itself shifts in the space while the main element moves relative to the main handle, i.e., the trajectory of the main element relative to the stationary main handle therefore being a translatory motion combined with a rotational movement of its own. As an alternative, it is possible to design the axis of rotation as a joint, by way of which the main handle is guided relative to the main element.

Advantageously, the entire joint-free or jointed axis of rotation is located in front of the main handle, the main handle being located behind the tool fitting relative to the tool axis. The location of the main handle behind the tool fitting is not intended to be a limitation. Instead, it is intended to define the direction for the axis of rotation located in front of the main handle. When the axis of rotation is located here, a high level of vibration damping can be obtained with main elements, the center of gravity of which is located at a relatively great distance from the tool axis. With main elements of this type, the location of the axis of rotation below a motor housing is particularly advantageous. It is also advantageous to locate the axis of rotation in front of the center of gravity and, in particular, below the center of gravity. The spacial direction "below" is intended to mean that the tool axis is located above the center of gravity.

A good damping of oscillations oriented in various directions can be obtained when the main element is movable relative to the main handle substantially in a plane that extends through the tool axis and in the normal direction. The main element is movable in two dimensions. The movability is essentially in the plane when the movability is given with a deviation of up to 5 mm and 10° relative to the plane. As a result of the guidance, a three-dimensional movability in the space is ruled out.

In a further advantageous embodiment of the present invention, the main handle is supported such that it is displaceable relative to the main element via at least two parallel guides.

The present invention is particularly suited for hand-held power tools with a motor axis oriented substantially perpendicularly to the tool axis. Hand-held power tools of this type are, e.g., a large drill, a rotary hammer, a rotary and chisel hammer, or a chisel hammer.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
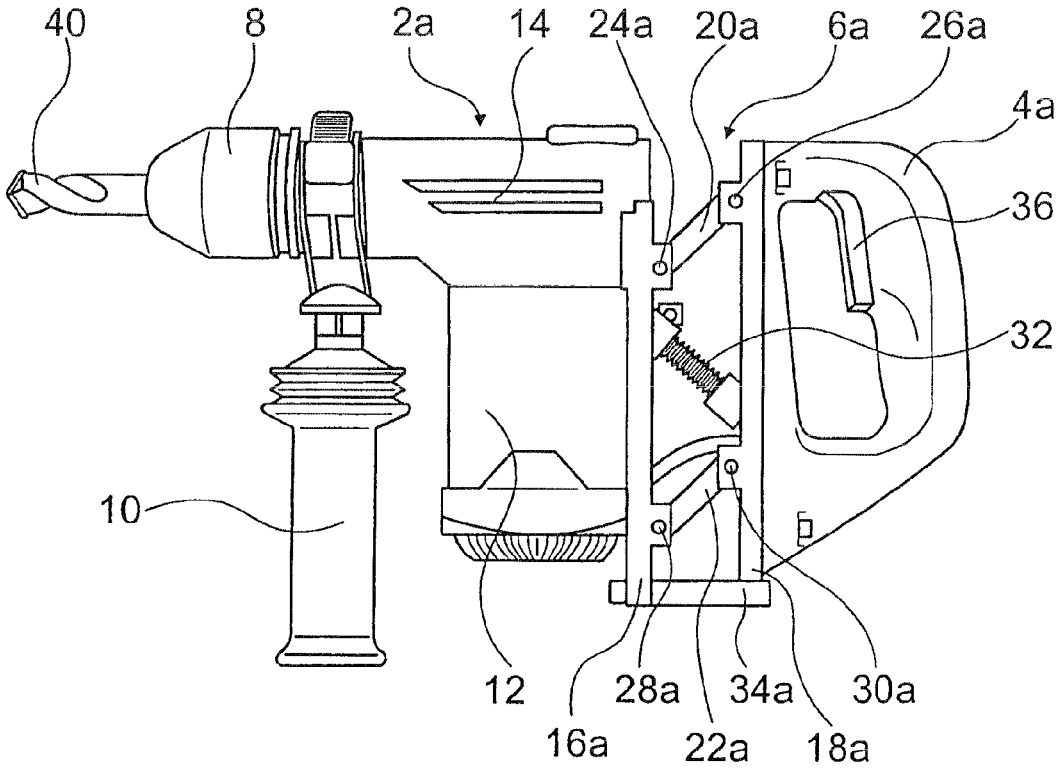
FIG. 1 Shows a side view of a rotary hammer with the housing removed.

FIG. 1 shows a hand-held power tool in the form of a rotary hammer. The hand-held power tool includes a main element 2*a* and a main handle 4*a*, which is fastened to main element 2*a* via a damping element 6*a*. Main element 2*a* includes a tool fitting 8, an additional handle 10, a motor 12 which is located inside a motor housing—and an impact mechanism 14, which is also hidden behind an inner housing.

Damping element 6*a* includes two connecting elements 16*a*, 18*a*, which are interconnected by two rotating elements 20*a*, 22*a* such that they are movable relative to each other. Rotating elements 20*a*, 22*a* are supported such that they can each rotate around two pivot axes 24*a*, 26*a*, 28*a*, 30*a*, so that main handle 4*a* is capable of swiveling relative to main element 2*a* around the four pivot axes 24*a*, 26*a*, 28*a*, 30*a*. Pivot axes 24*a*, 26*a*, 28*a*, 30*a* are formed by supports, by way of which rotating elements 20*a*, 22*a* are pivotably supported.

Connecting elements 16*a*, 18*a* are pressed apart by a spring element 32, so that connecting element 18*a* rests against a stop 34*a*. In the position shown in FIG. 1, the hand-held power tool is in the stationary position, and no external forces act on main element 2*a* or main handle 4*a*. Main handle 4*a* includes all rigidly interconnected elements of main handle 4*a*, including a switch 36 and the elements connected therewith, e.g., connecting element 18*a*. All remaining elements of damping element 6*a* are assigned to main element 2*a*. Main element 2*a* can carry additional elements not shown in the Figures.

Figure 2:
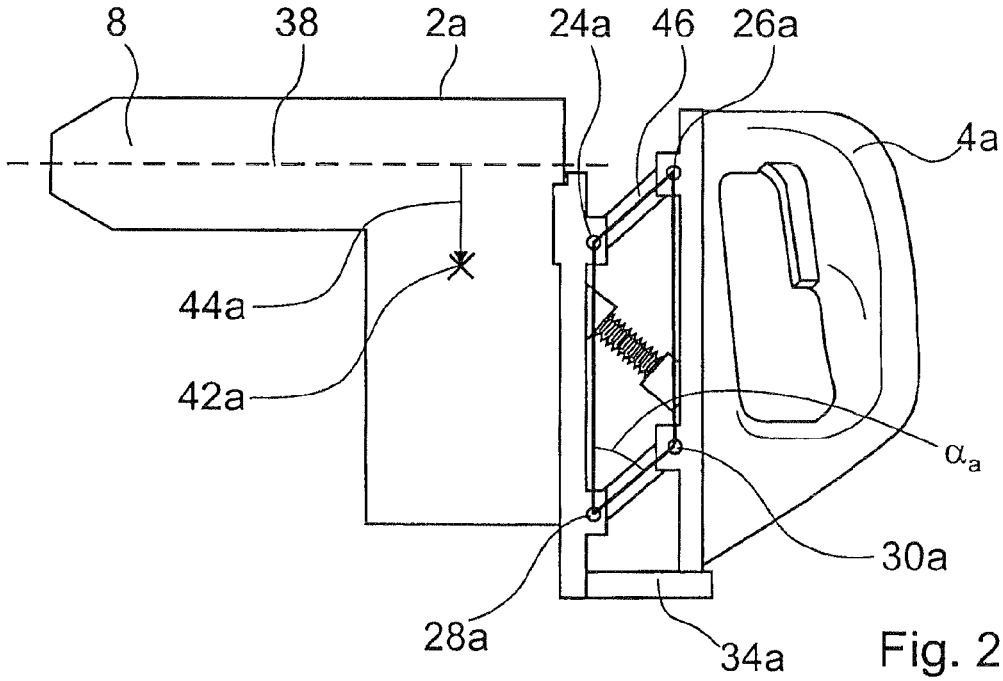
FIG. 2 Shows a schematic depiction of the rotary hammer in FIG. 1 with the tool axis and center of gravity sketched in, FIG. 3 Shows the schematic depiction in FIG. 3 with an additional displacement of a main element of the hand-held power tool caused by a trajectory, FIG. 4 Shows a side view of a further rotary hammer with a somewhat different damping element, FIG. 5 Shows a schematic depiction of the hand-held power tool in FIG. 4, FIG. 6 Shows a schematic depiction of the trajectory of the main element of the hand-held power tool in FIGS. 4 and 5, FIG. 7 Shows a side view of a further rotary hammer with a damping element capable of moving around only one axis of rotation, FIG. 8 Shows the motion of the main element of the hand-held power tool in FIG. 7 around the axis of rotation, FIG. 9 Shows a hand-held power tool with an insertable damping element, FIG. 10 Shows the trajectory of the main element of the hand-held power tool in FIG. 9, FIG. 11 Shows a hand-held power tool with a damping element with two elastomer strips, and FIG. 12 Shows a motion of the main element corresponding to the deformation of the elastomer strips.

FIG. 2 shows the hand-held power tool in FIG. 1 with a schematically indicated main element 2*a*. A tool axis 38 is indicated, the tool axis being determined by tool fitting 8 and a tool 40 clamped fixedly therein. Also shown is a center of gravity 42*a* of main element 2*a*, which is located, e.g., below tool axis 38. A normal direction 44*a* that points downward extends perpendicularly from tool axis 38 and points toward center of gravity 42*a*. To illustrate the stationary position, a trapezoid 46 that symbolically connects pivot axes 24*a*, 26*a*, 28*a*, 30*a* is shown.

Figure 3:
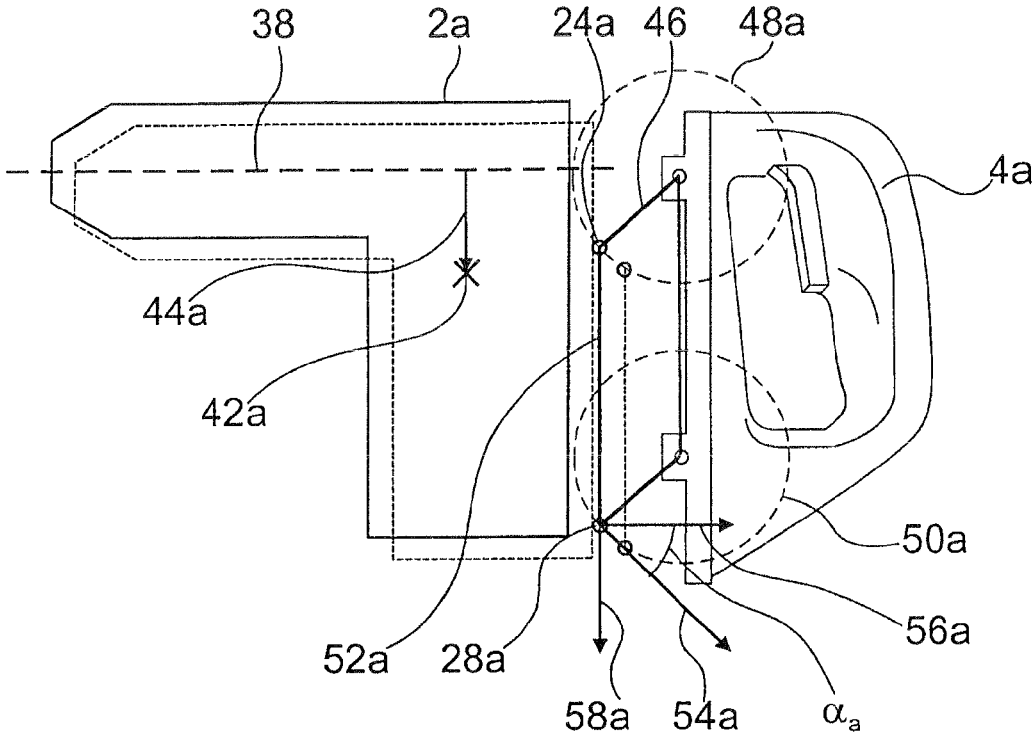

A further schematization of the hand-held power tool in FIGS. 1 and 2 is shown in FIG. 3. Trapezoid 46 is also shown in the stationary position. When main handle 4*a* moves relative to main element 2*a* or when main element 2*a* makes an equivalent motion relative to stationary main handle 4*a*, main element 2*a* is displaced, e.g., out of the stationary position indicated by a solid line into the position indicated by the dashed line. Pivot axis 24*a* moves in the counterclockwise direction on a circular trajectory 48*a*, and pivot axis 28*a* moves in the counterclockwise direction on a circular trajectory 50*a*. A line 52*a* of trapezoid 46 imagined to connect pivot axes 24*a* and 28*a* is displaced from the position indicated by the solid line into the position indicated by the dashed line. Main element 2*a* is thereby displaced on a circular trajectory in a direction of motion 54*a*.

Direction of motion 54*a* is composed of a movement component 56*a* parallel to tool axis 38 and a movement component 58*a* parallel to normal direction 44*a*. In this manner, main element 2*a* is guided in normal direction 44*a* along a trajectory with a movement component 58*a*. Or—in other words—main handle 4*a*, when moved out of its stationary position toward main element 2*a*, is guided in a direction of motion 54*a* at an angle to tool axis 38. Stop 34*a* should be designed such that a slant with an angle $\alpha_a$ of at least 10°, in particular at least 20°, is given.

With a hand-held power tool such as the one shown in FIGS. 1 through 3, the trajectory of main element 2*a* remains in the plane of the page and is therefore a one-dimensional, circular linear motion. In this manner, oscillation of main element 2*a* in direction of motion 54*a* can be largely absorbed by damping element 6*a*, main element 2*a* being capable of oscillating freely while main handle 4*a* remains stationary.

Direction of motion 54*a* may include an additional movement component perpendicular to movement components 56*a* and 58*a* if, e.g., circular trajectories 48*a* and 50*a* are not exactly parallel to normal direction 44*a*; this does not substantially affect the principles of the present invention.

Figure 4:
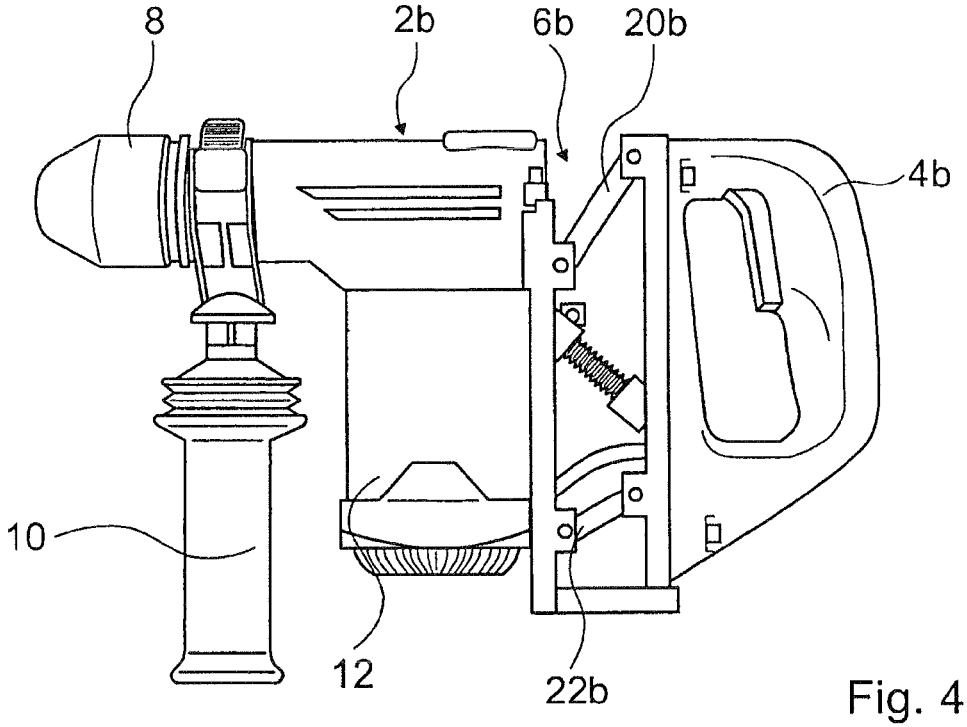
Figure 5:
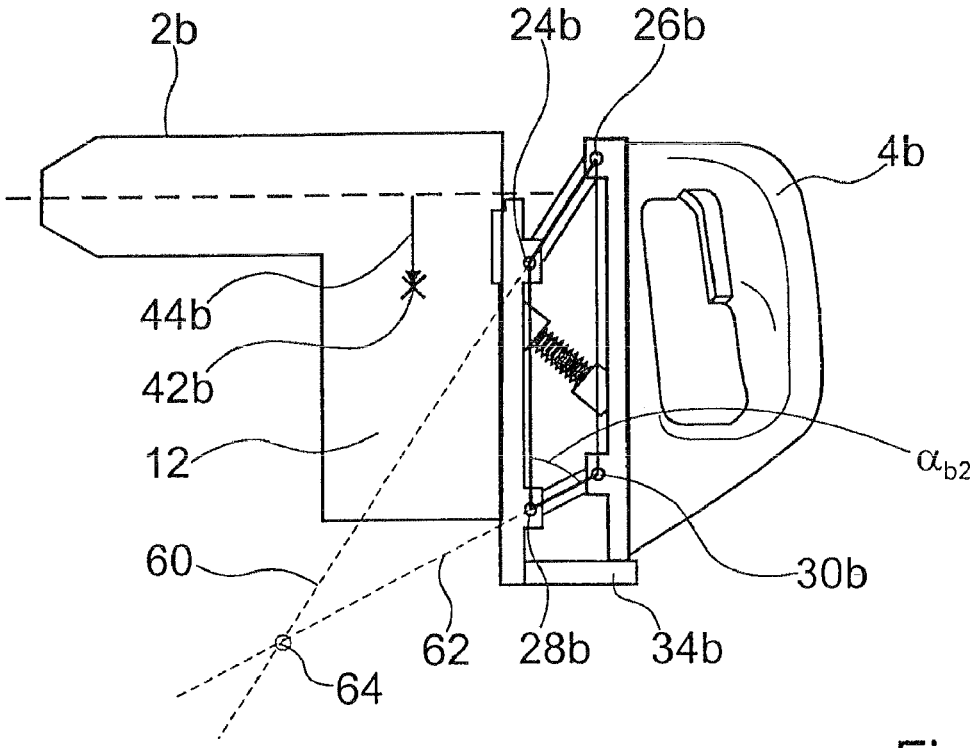

FIG. 4 shows a further hand-held power tool that is very similar to the hand-held power tool shown in FIGS. 1 through 3, with the only difference being that it has a slightly different damping element 6*b*. Refer to the description of the exemplary embodiment in FIGS. 1 through 3 for the features and functionalities that are the same. The description below is essentially limited to the differences from the exemplary embodiment in FIGS. 1 through 3. Damping element 6*b* includes two rotating elements 20*b*, 22*b* having different lengths and that are oriented at an angle of approximately 30° relative to each other. As a result, lines 60, 62 shown in FIG. 5—which extend through pivot axes 24*b*, 26*b*—intersect at an axis of rotation 64.

Figure 6:
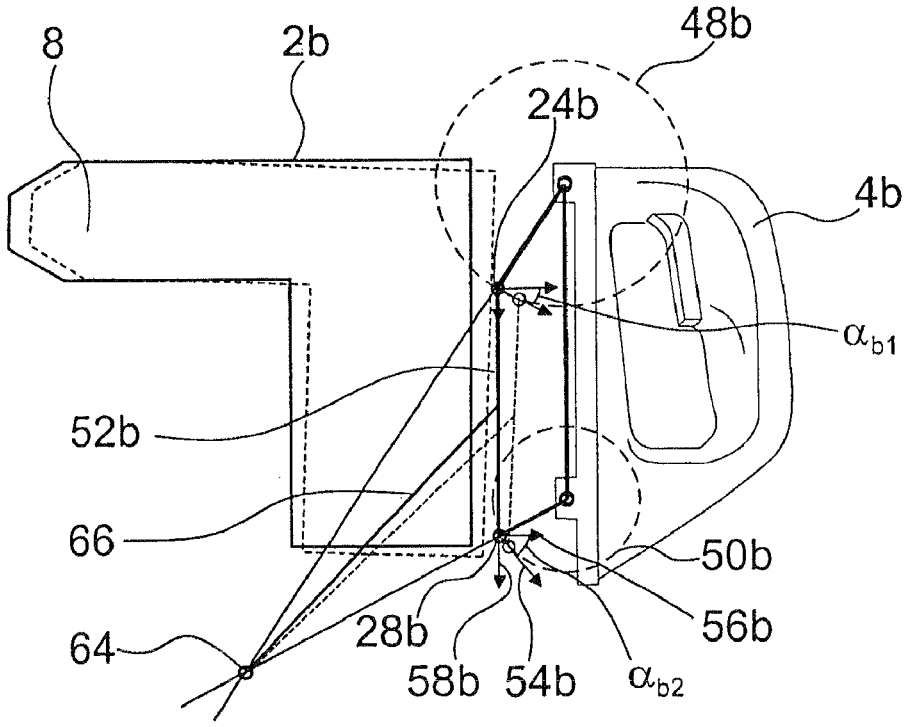

A motion of main element 2*b* out of the stationary position indicated by a solid line into a position indicated by a dashed line is indicated schematically in FIG. 6. A motion of this type results in main element 2*b* approaching main handle 4*b* and results in pivot axes 24*b*, 28*b* moving in the counterclockwise direction on circular trajectories 48*b*, 50*b*. A line 52*b* that connects pivot axes 24*b*, 28*b* is thereby moved out of the stationary position indicated by the solid line into the position indicated by the dashed line. While, as shown in FIG. 3, main element 2*a* was displaced downward and rearward in parallel i.e., entire main element 2*a* has the same movement components 58*a* in normal direction 44*a*, when main element 2*b* moves, main element 2*b* also makes a rotational movement of its own in addition to the parallel displacement shown in FIG. 3. This combined motion causes main element 2*b* to rotate around axis of rotation 64.

Nearly the entire main element 2*b* makes a motion with a movement component 58*b* in normal direction 44*b*, the portion of movement components 58*b* involved in direction of motion 54*b* in the lower part of main element 2*b* comprising more than 50% and decreasing in the upward direction. In the region of tool fitting 8, main element 2*b* makes a slight motion upward, so that it is guided there along a trajectory with a movement component opposite to normal direction 44*b*. A portion of more than 90% of main element 2*b* has a movement component 58*b* in normal direction 44*b*, however. A stop 34*b* is designed such that direction of motion 54*b* has a slant with an angle $\alpha_{b1}$ of approximately 30° or an angle $\alpha_{b2}$ of approximately 60°. The slant or tilt is directed downward, i.e., toward a flat surface imagined to extend through tool axis 38 with normal direction 44*b* as the surface normal, in the direction of the half-space in which the center of gravity is located.

To illustrate the rotation of main element 2*b* around axis of rotation 64, a further, randomly positioned line 66 is connected to line 52*b* and extended toward axis of rotation 64. When line 66 is moved rigidly with line 52*b* out of the resting position into the position indicated by a dashed line, line 66 is moved out of the position indicated by the solid line into the position indicated by the dashed line. The end of dashed line 66 remains at an extremely small distance away from axis of rotation 64, thereby clearly showing that axis of rotation 64 does not remain statically stationary by the motion of main element 2*b*, but rather makes a very small motion. Axis of rotation 64 is located outside of the hand-held power tool and, in fact, in front of main handle 4*b*, and in front of and behind center of gravity 42*b* and motor 12.

Figure 7:
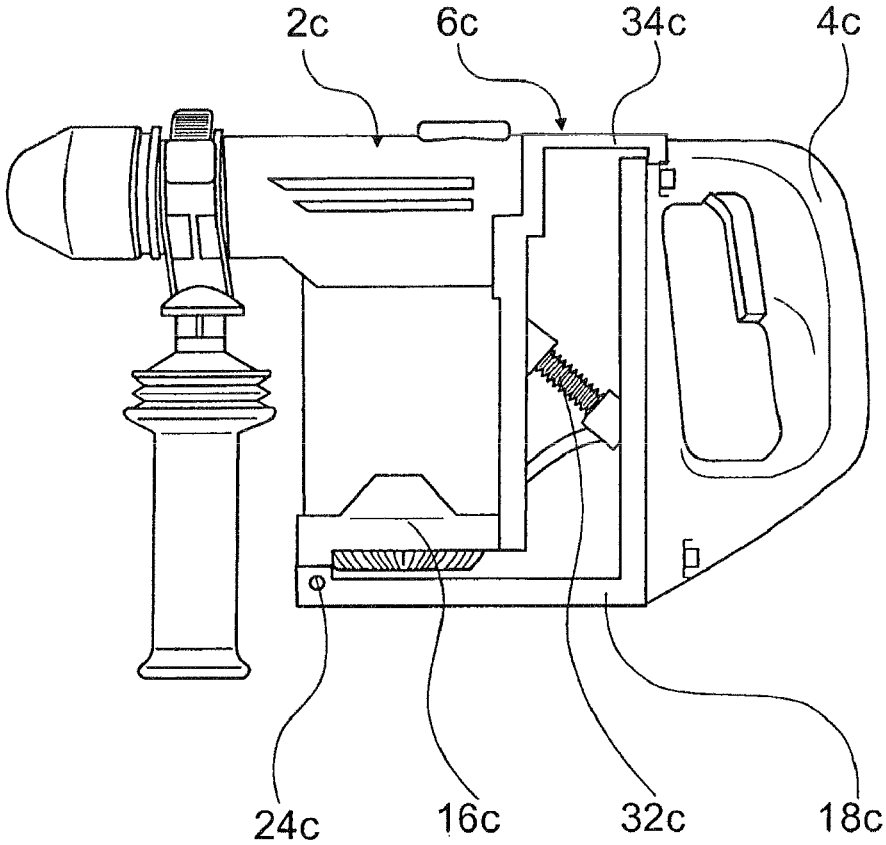
Figure 8:
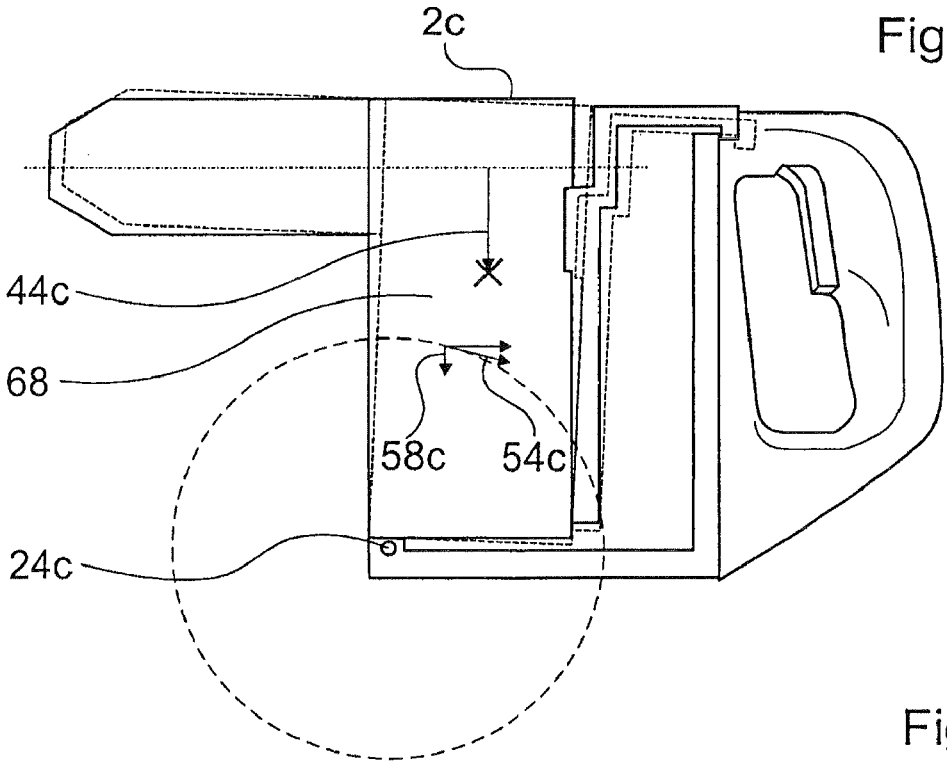

Shown in FIG. 7 is a further hand-held power tool with a main element 2*c*, a main handle 4*c* and a damping element 6*c*. Damping element 6*c* includes two connecting elements 16*c*, 18*c*, which are fastened together such that they are rotatable on a pivot axis 24*c*. Connecting element 16*c* includes a stop 34*c* that encompasses connecting element 18*c* and therefore creates a stationary position as shown in FIG. 7, into which connecting elements 16*c*, 18*c* are pressed by spring element 32. When an operator moves main element 2*c* and main handle 4*c* toward each other, entire main element 2*c* moves out of the stationary position shown in FIG. 7 and into a position shown in FIG. 8 as a dashed line, thereby rotating around pivot axis 24*c*. A portion 68 of main element 2*c* is moved far downward, so that its trajectory in direction of motion 54*c* has a small movement component 58*c* in normal direction 44*c*. This portion 68 includes more than half of the weight component of main element 2*c*.

Figure 9:
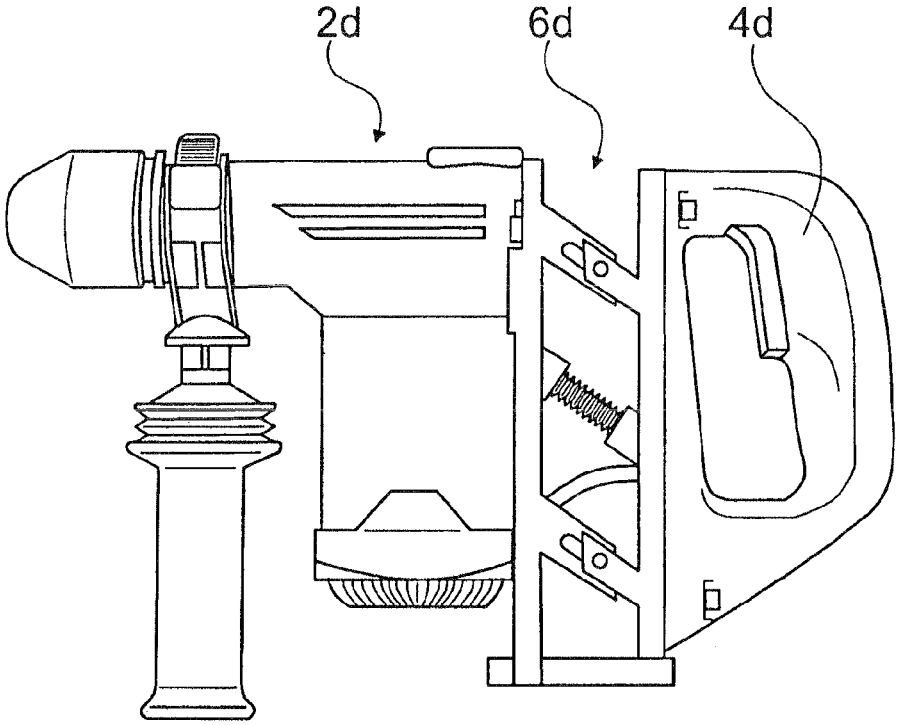
Figure 10:
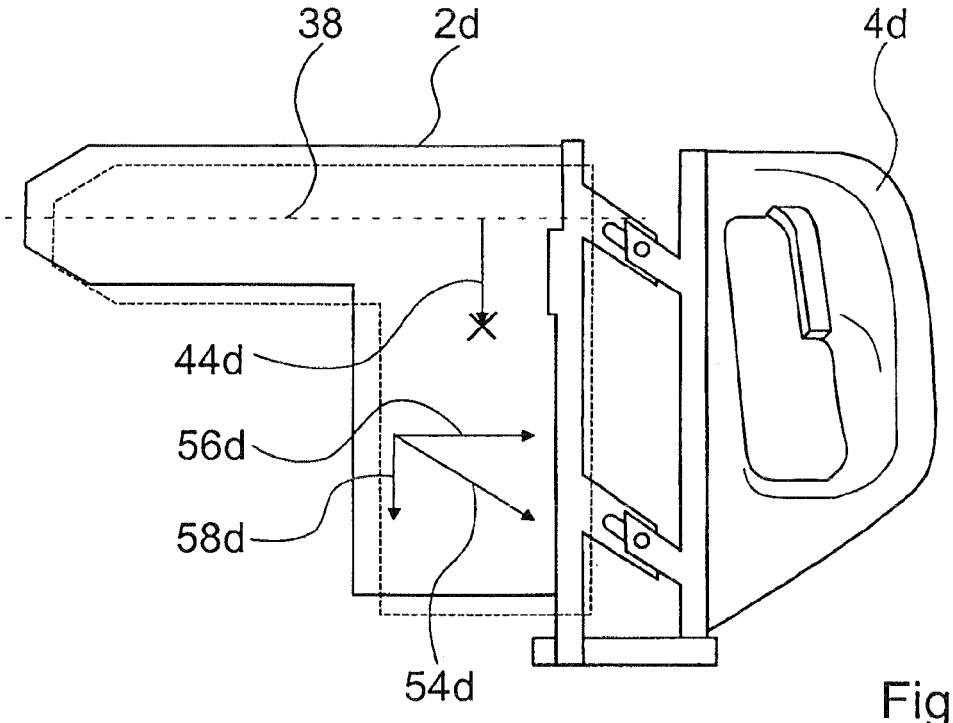

A further exemplary embodiment is shown in FIGS. 9 and 10. A main handle 4*d* of a rotary hammer is supported on a main element 2*d* such that it is displaceable by a damping element 6*d*. When main handle 4*d* is pressed in the direction toward main element 2*d*, main element 2*d* and main handle 4*d* are moved toward each other, main element 2*d*—as shown in FIG. 10—being displaced out of the resting position into the position indicated by the dashed line. Entire main element 2*d* is displaced on a trajectory in direction of motion 54*d*, which has a movement component 58*d* in normal direction 44*d* and a somewhat greater movement component 56*d* parallel to tool axis 38.

Figure 11:
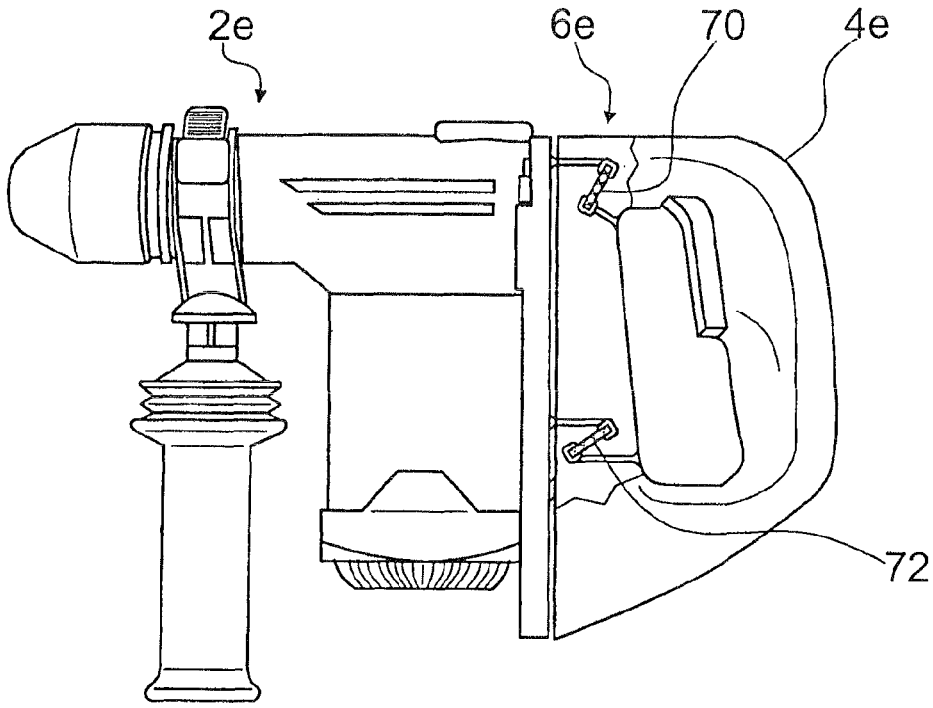
Figure 12:
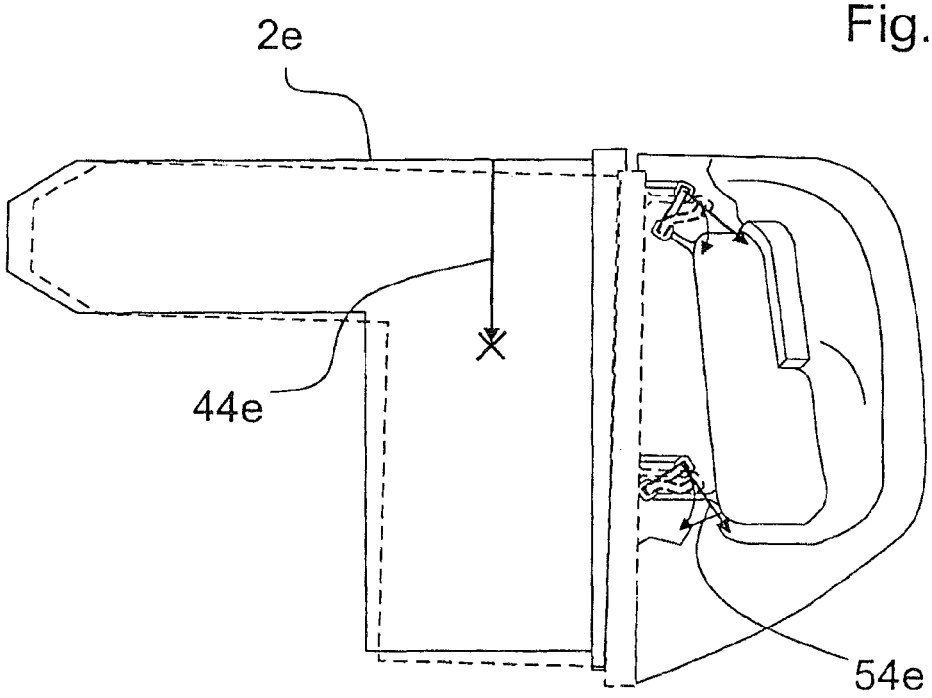

A further exemplary embodiment with a connecting element 6*e* with elastomer strips 70, 72 is shown in FIGS. 11 and 12. Elastomer strips 70, 72, which have their greatest expansion perpendicular to the plane of the page in FIGS. 11 and 12, connect a main element 2*e* with a main handle 4*e*. Although they are bendable, as shown in FIG. 12, they are essentially fixed in their longitudinal extension, so that they only permit a circular motion to be carried out, as indicated in FIG. 12 by arrows. The resultant motion of main element 2*e* is one-dimensional, i.e., in a curved line, and is guided with a movement component 54*e* in normal direction 44*e*.

It will be understood that each of the elements described above, or two or more together, may also find a useful application in other types of constructions differing from the types described above.

While the invention has been illustrated and described as embodied in hand-held power tool, it is not intended to be limited to the details shown, since various modifications and structural changes may be made without departing in any way from the spirit of the present invention.

Without further analysis, the foregoing will reveal fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims.

1. A hand-held power tool with vibration-damped handle, said hand-held power tool comprising:

a main element;

a main handle fastened to said main element, said main handle being supported such that said main handle is movable relative to said main element, said main element including a tool fitting that defines a longitudinal tool axis and a center of gravity, wherein a normal direction that originates from said longitudinal tool axis and is oriented perpendicular to said longitudinal tool axis points toward said center of gravity; and means for fastening said main handle to said main element configured so that when said main element is moved out of a stationary position toward said main handle at least a portion of said main element is guided along a trajectory having a movement component in the normal direction, wherein said means for fastening said main handle to said main element are configured so that said trajectory extends with a slant of at least 10° relative to an imaginary flat surface extending through the longitudinal tool axis, with the normal direction perpendicular to the longitudinal tool axis as a surface normal of the flat surface, in a direction of a half-space the hand-held power tool further comprising a spring element, wherein said means for fastening are configured so that said main handle is swivelable around at least one swivel axis relative to said main element, wherein said means for fastening include at least one rotating element configured so that said main handle is swivelable via said rotating element around said at least one swivel axis and relative to said main element, wherein said spring element extends mainly in a selected direction, wherein said selected direction is only oriented at an angle relative to the flat surface that is greater than 10°, wherein the selected direction is substantially perpendicular to a direction in which the rotating element extends mainly when the main element is in the stationary position.

2. The hand-held power tool as defined in claim 1, wherein said means for fastening are configured so that said main handle is swivelable around at least two swivel axes relative to said main element.

3. The hand-held power tool as defined in claim 1, wherein said means for fastening include two rotating elements configured so that said main handle is swivelable via said two rotating elements around said two swivel axes and relative to said main element.

4. The hand-held power tool as defined in claim 3, wherein said rotating elements have different lengths.

5. The hand-held power tool as defined in claim 3, wherein said rotating elements are each supported in a support at their ends facing away from said main handle, and a straight line extending through said support forms an angle >45° with said longitudinal tool axis.

6. The hand-held power tool as defined in claim 1, wherein said means for fastening are configured so that the motion of said main handle relative to said main element is a linear motion.

7. The hand-held power tool as defined in claim 6, wherein said means for fastening said main handle to said main element are configured so that said trajectory is straight.

8. The hand-held power tool as defined in claim 7, comprising at least one parallel guide, wherein said parallel guide supports the main handle such that the main handle is displaceable relative to the main element in a translational motion.

9. The hand-held power tool as defined in claim 1, wherein said main handle is stationary and said main element makes a rotational movement around a joint-free axis of rotation when it moves from a stationary position and approaches said main handle.

10. The hand-held power tool as defined in claim 9, wherein said main handle, relative to said longitudinal tool axis, is located behind said tool fitting, and said axis of rotation is located completely in front of said main handle.

11. The hand-held power tool as defined in claim 9, wherein said main handle, relative to said longitudinal tool axis is located behind said tool fitting, and said axis of rotation as a whole is located in front of said center of gravity.

12. The hand-held power tool as defined in claim 1, wherein said at least a portion of said main element has a weight that is at least 10% of that of said main element.

13. The hand-held power tool as defined in claim 1, wherein said means for fastening said main handle to said main element are configured so that the movement component of the at least a portion of the main element in the normal direction comprises at least 18% of a total movement of the portion.

14. The hand-held power tool as defined in claim 1, wherein said means for fastening said main handle to said main element are configured so that said trajectory of said at least a portion of said main element extends with a slant of at least 20° relative to said flat surface.

15. The hand-held power tool as defined in claim 1, wherein said means for fastening said main handle to said main element are configured so that said trajectory of said at least a portion of said main element extends with a slant of at least 30° relative to said flat surface.

16. The hand-held power tool as defined in claim 1, wherein said means for fastening said main handle to said main element are configured so that said trajectory of said at least a portion of said main element extends with a slant of at least 60° relative to said flat surface.

17. The hand-held power tool as defined in claim 1, wherein said means for fastening said main handle to said main element are configured so that said trajectory is circular.

18. The hand-held power tool as defined in claim 1, comprising a motor with a motor axis oriented substantially perpendicularly to the longitudinal tool axis.

19. The hand-held power tool as defined in claim 1, comprising a stop which is designed such that said trajectory of the at least a portion of the main element starts from the stationary position with said slant of at least 10° relative to the flat surface.

20. The hand-held power tool as defined in claim 1, wherein said angle is greater than 30°.

* * * * *